US009003949B2

(12) United States Patent
Roman

(10) Patent No.: US 9,003,949 B2
(45) Date of Patent: Apr. 14, 2015

(54) AUTOMATIC PNEUMATIC VALVE RESET SYSTEM

(75) Inventor: Timothy S. Roman, Minnetonka, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 919 days.

(21) Appl. No.: 13/135,027

(22) Filed: Jun. 23, 2011

(65) Prior Publication Data

US 2012/0036991 A1 Feb. 16, 2012

Related U.S. Application Data

(60) Provisional application No. 61/357,868, filed on Jun. 23, 2010.

(51) Int. Cl.
*F01L 29/06* (2006.01)
*F01L 23/00* (2006.01)

(52) U.S. Cl.
CPC *F01L 23/00* (2013.01); *F01L 29/06* (2013.01)

(58) Field of Classification Search
CPC ..... F01L 23/00; F01L 29/06
USPC ..... 91/307, 313
See application file for complete search history.

(56) References Cited

U.S. PATENT DOCUMENTS

| | | | | | |
|---|---|---|---|---|---|
| 335,855 | A * | 2/1886 | Toole | 91/307 |
| 522,071 | A * | 6/1894 | Mason | 91/307 |
| 603,399 | A * | 5/1898 | Drewett | 91/307 |
| 1,406,330 | A * | 2/1922 | Barner | 91/307 |

* cited by examiner

*Primary Examiner* — F. Daniel Lopez
(74) *Attorney, Agent, or Firm* — Kinney & Lange, P.A.

(57) ABSTRACT

A cup for an air valve assembly in a positive displacement pneumatic motor includes a cup body, a gas cavity, and a first pilot slot. The cup body is rectilinear and has a sliding face as one side, and the gas cavity is concave and extends into the cup body through the sliding face and terminates within the cup body. The first pilot slot extends from the gas cavity and into the cup body through the sliding face and terminates within the cup body.

13 Claims, 6 Drawing Sheets

AUTOMATIC PNEUMATIC VALVE RESET SYSTEM

BACKGROUND

Positive displacement pneumatic motors are used in a variety of applications because of their inherent ease of use, constant force output, safe operation in explosive environments, among other reasons. They function by supplying compressed gas to either a primary piston and/or diaphragm that then pushes against a load such as a pump. At the end of each stroke, the motor must exhaust the high pressure air and move in the opposite direction to repeat the cycle. The control of the movement of the primary piston and/or diaphragm is accomplished by an air valve assembly connected to limit switches that sense the movement of the primary piston and/or diaphragm. The construction of the typical air valve assembly creates a point at which the valve can become centered and stuck. During normal operation, the air valve assembly moves fast enough past the center point to avoid stopping. However, at times, the air valve assembly can be slowed due to causes such as low gas pressure or fouling (such as ice build up due to the expanding gas). If the air valve assembly subsequently gets centered and stuck, even if the fouling is removed (for example, the ice melts) or if the proper air pressure is restored, the motor will need an operator to manually restart it, possibly requiring disassembly of the motor.

SUMMARY

According to one embodiment of the present invention, a cup for an air valve assembly in a positive displacement pneumatic motor includes a cup body, a gas cavity, and a first pilot slot. The cup body is rectilinear and has a sliding face as one side, and the gas cavity is concave and extends into the cup body through the sliding face and terminates within the cup body. The first pilot slot extends from the gas cavity and into the cup body through the sliding face and terminates within the cup body.

In another embodiment, an air valve assembly includes a plate and a cup. The plate has a first chamber port, a second chamber port, an exhaust port, and a reset port. The cup includes a cup body, a gas cavity, and a first pilot slot. The cup body has a sliding face as one side, and the gas cavity extends into the cup body through the sliding face. The first pilot slot extends from the gas cavity and into the cup body through the sliding face.

In another embodiment, a positive displacement pneumatic motor includes a motor body, a pneumatic inlet, a primary piston, an air valve assembly, and a limit switch. The pneumatic inlet is attached to the motor body for supplying compressed gas to the motor. The primary piston is positioned in the motor body and moves due to force from the compressed air. The air valve assembly includes a cup that is slidable between a first exhaust position, a stall position, and a second position, wherein the position of the cup controls the flow of compressed air in the motor. The limit switch is activated when the primary piston moves a sufficient distance. The limit switch sends a first signal when it is activated to the air valve assembly, and the air valve assembly moves the cup between the first and second positions due to the signal. The cup sends a second signal to the air valve assembly when the air valve assembly is in the stall position to move the cup to the first position.

DETAILED DESCRIPTION

Figure 1:
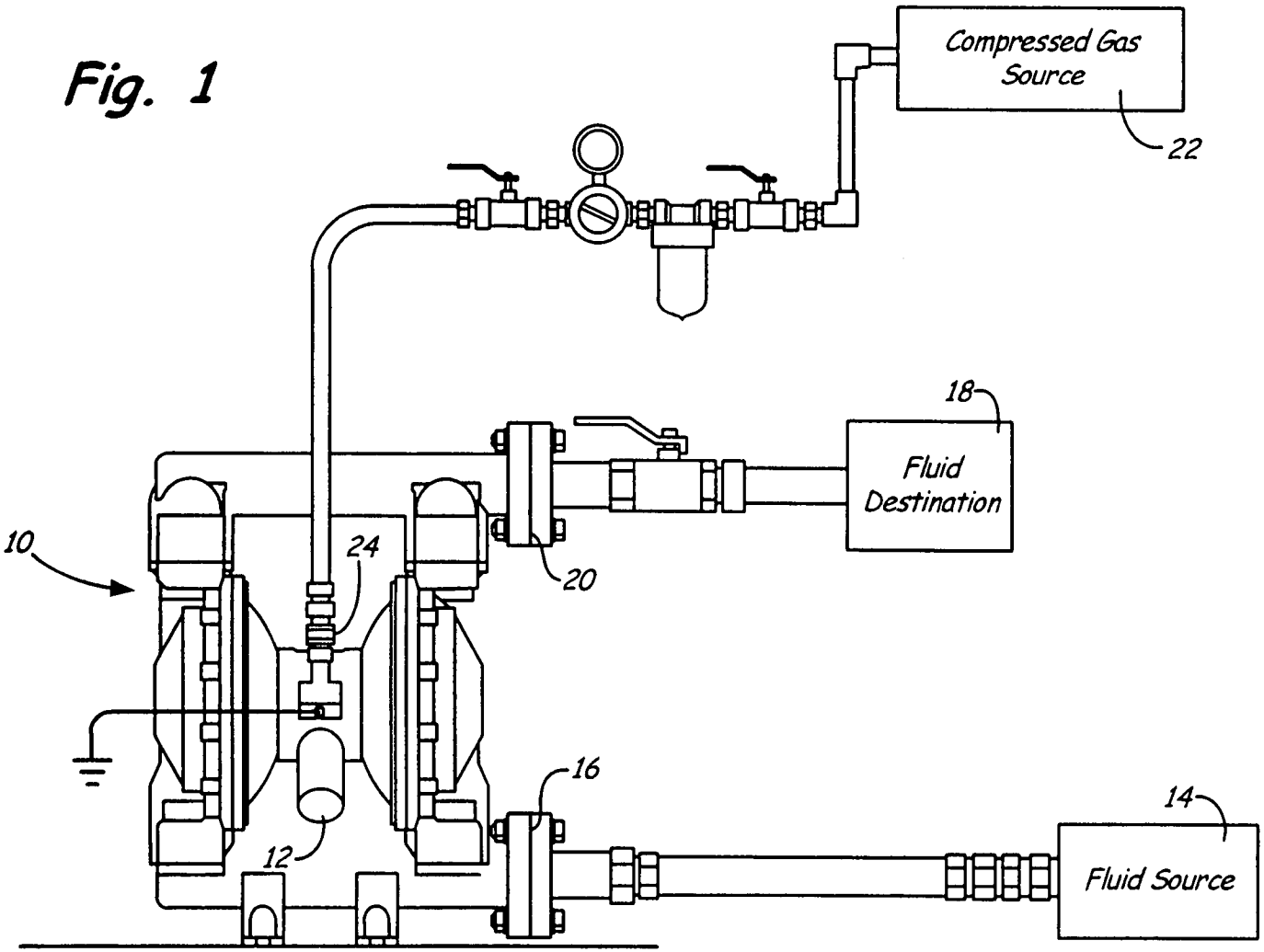
FIG. 1 is a front view of a positive displacement pneumatic motor.

In FIG. 1, a front view of positive displacement pneumatic motor 10 is shown. Shown in FIG. 1 are motor 10, muffler 12, fluid source 14, fluid inlet 16, fluid destination 18, fluid outlet 20, compressed gas source 22, and pneumatic inlet 24.

Motor 10 is connected to fluid source 14 at fluid inlet 16 and to fluid destination 18 at fluid outlet 20. Motor 10 is also connected to compressed gas source 22 at pneumatic inlet 24. Attached to the exterior of motor 10 is muffler 12.

In the illustrated embodiment, motor 10 is a double diaphragm pump. Motor 10 uses compressed gas from compressed gas source 22 to pump fluid from fluid source 14 to fluid destination 18. As part of the working cycle of motor 10, used compressed gas is exhausted to the atmosphere through muffler 12.

Depicted in FIG. 1 is one embodiment of the present invention, to which there are alternative embodiments. For example, motor 10 can be a different type of pneumatic device, such as, a double acting pneumatic cylinder. In such an embodiment, motor 10 is a reciprocating actuator that can be used to move objects back and forth. In addition, fluid source 14, fluid inlet 16, fluid destination, and fluid outlet 20 may not be required for motor 10 to operate.

Figure 2:
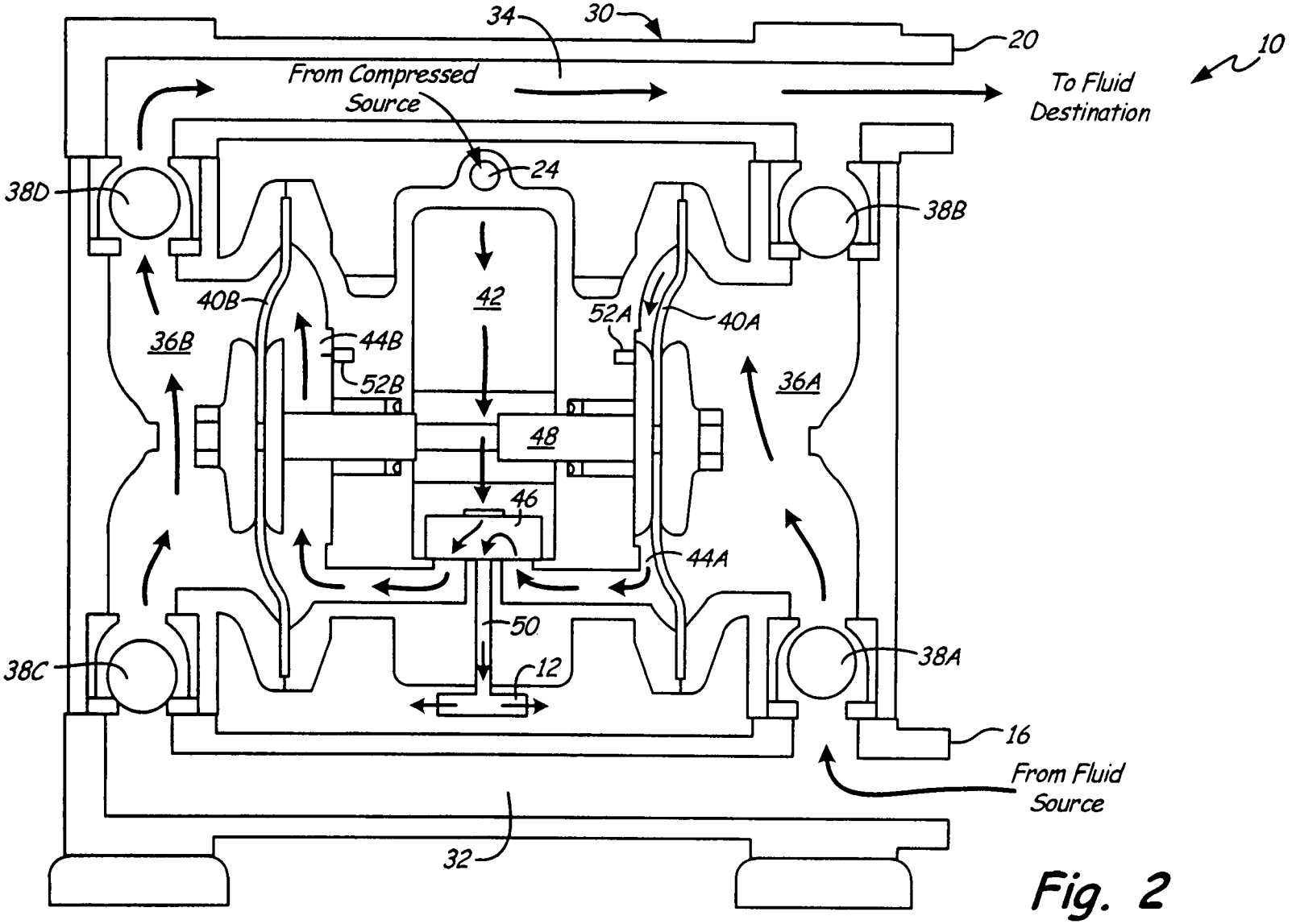
FIG. 2 is a front cross-section view of the positive displacement pneumatic motor showing fluid flow.

In FIG. 2, a front cross-section view of positive displacement pneumatic motor 10, including internal fluid flow, is shown. Shown in FIG. 2 are motor 10, muffler 12, fluid inlet 16, fluid outlet 20, pneumatic inlet 24, motor body 30, inlet manifold 32, outlet manifold 34, fluid chambers 36A-36B, check valves 38A-38D, diaphragms 40A-40B, gas manifold 42, gas chambers 44A-44B, air valve assembly 46, primary piston 48, pneumatic outlet 50, and limit switches 52A-52B.

Motor 10 has motor body 30 which includes fluid inlet 16, fluid outlet 20, and pneumatic inlet 24. Fluidly connected to fluid inlet 16 is inlet manifold 32 and fluidly connected to fluid outlet 20 is outlet manifold 34. Extending between inlet manifold 32 and outlet manifold 34 are fluid chambers 36A-36B. Fluid chamber 36A is bounded by motor body 30, check valves 38A-38B, and diaphragm 40A. Fluid chamber 36B is bounded by motor body 30, check valves 38C-38D, and diaphragm 40B.

Fluidly connected to pneumatic inlet 24 is gas manifold 42, with gas manifold 42 being fluidly connected to gas chambers 44A-44B. Gas chambers 44A-44B are bounded by motor body 30 and diaphragms 40A-40B, respectively. Slidably positioned in gas manifold 42, motor body 30, and gas chambers 44A-44B is primary piston 48. Primary piston 48 is connected to diaphragm 40A at one end and to diaphragm 40B at the opposite end.

Attached to motor body 30 and positioned in gas manifold 42 near gas chambers 44A-44B is air valve assembly 46. Air valve assembly 46 is fluidly connected to gas manifold 42, gas chambers 44A-44B, and pneumatic outlet 50. In addition, fluidly connected to pneumatic outlet 50 and attached to motor body 30 is muffler 12.

More specifically, air valve assembly 46 controls the flow of gas in motor 10 by selectively connecting one gas chamber 44 with gas manifold 42 and the other gas chamber 44 with pneumatic outlet 50. Air valve assembly 46 makes its selections with the aid of limit switches 52A-52B. Limit switches 52A-52B are attached to motor body 30 and extend into gas chambers 44A-44B, respectively. In the illustrated embodiment, limit switches 52A-52B are pneumatic pilot valves that are fluidly connected to air valve assembly 46 and pneumatic outlet 50 (the pathways through motor body 30 for these connections are not shown).

In order to pump fluid from fluid source 14 to fluid destination 18 (both shown in FIG. 1), air valve assembly 46 controls gas flow in motor 10. As indicated by the flow arrows in FIG. 2, air valve assembly 46 has connected gas chamber 44B with gas manifold 42 and gas chamber 44A with pneumatic outlet 50. This causes compressed gas from gas manifold 42 to flow into gas chamber 44B through air valve assembly 46. The compressed gas exerts force on diaphragm 40B, expanding gas chamber 44B and causing diaphragm 40B and primary piston 48 to move toward fluid chamber 36B. This movement reduces the volume of fluid chamber 36B, forcing fluid contained therein through check valve 38D into outlet manifold 34 (because check valve 38C prevents backflow into inlet manifold 32).

The movement of primary piston 48 reduces the volume of gas chamber 44A. Because air valve assembly 46 has fluidly connected gas chamber 44A with pneumatic outlet 50, the compressed gas in gas chamber 44A flows through air valve assembly 46 and pneumatic outlet 50, into muffler 12, and out to the atmosphere. The movement of primary piston 48 also expands fluid chamber 36A, which causes fluid to be drawn up through check valve 38A from inlet manifold 32 (because check valve 38B prevents backflow from outlet manifold 34).

At the end of the stroke of primary piston 48, limit switch 52A will be activated. This sends a signal to air valve assembly 46, causing air valve assembly 46 to fluidly connect gas chamber 44B with pneumatic outlet 50 and gas chamber 44A with gas manifold 42. In the illustrated embodiment, the signal is a pneumatic signal that directs gas through a series of fluid connections. The exact flow path being used to send the signal will be described later with FIGS. 3A-3B.

Then the cycle continues with the roles of fluid chambers 36A-36B and gas chambers 44A-44B being reversed, respectively. More specifically, fluid chamber 36A will force fluid into outlet manifold 34 while fluid chamber 36B will draw in fluid from inlet manifold 32. In addition, gas chamber 44A will receive compressed gas from gas manifold 42 while gas chamber 44B will exhaust gas to the atmosphere through muffler 12. At the end of the stroke of primary piston 48, limit switch 52B will be activated. This sends a signal to air valve assembly 46, causing air valve assembly 46 to reverse the fluid connections to gas chambers 44A-44B, starting the cycle of operation over again. In the illustrated embodiment, the signal is a pneumatic signal that directs gas through a series of fluid connections. The exact flow path being used to send the signal will be described later with FIGS. 3A-3B.

The components and configuration of motor 10 as shown in FIG. 2 allow for compressed gas from compressed gas source 22 (shown in FIG. 1) to be used to pump fluid from fluid source 14 to fluid destination 18 (both shown in FIG. 1). More specifically, air valve assembly 46 can control the movement of primary piston 48 and diaphragms 40A-40B.

Depicted in FIG. 2 is one embodiment of the present invention, to which there are alternative embodiments. For example, limit switches 52A-52B can have their own respective exhaust ports. In such an embodiment, fluid connections between limit switches 52A-52B and pneumatic outlet 50 are not required.

Figure 3A:
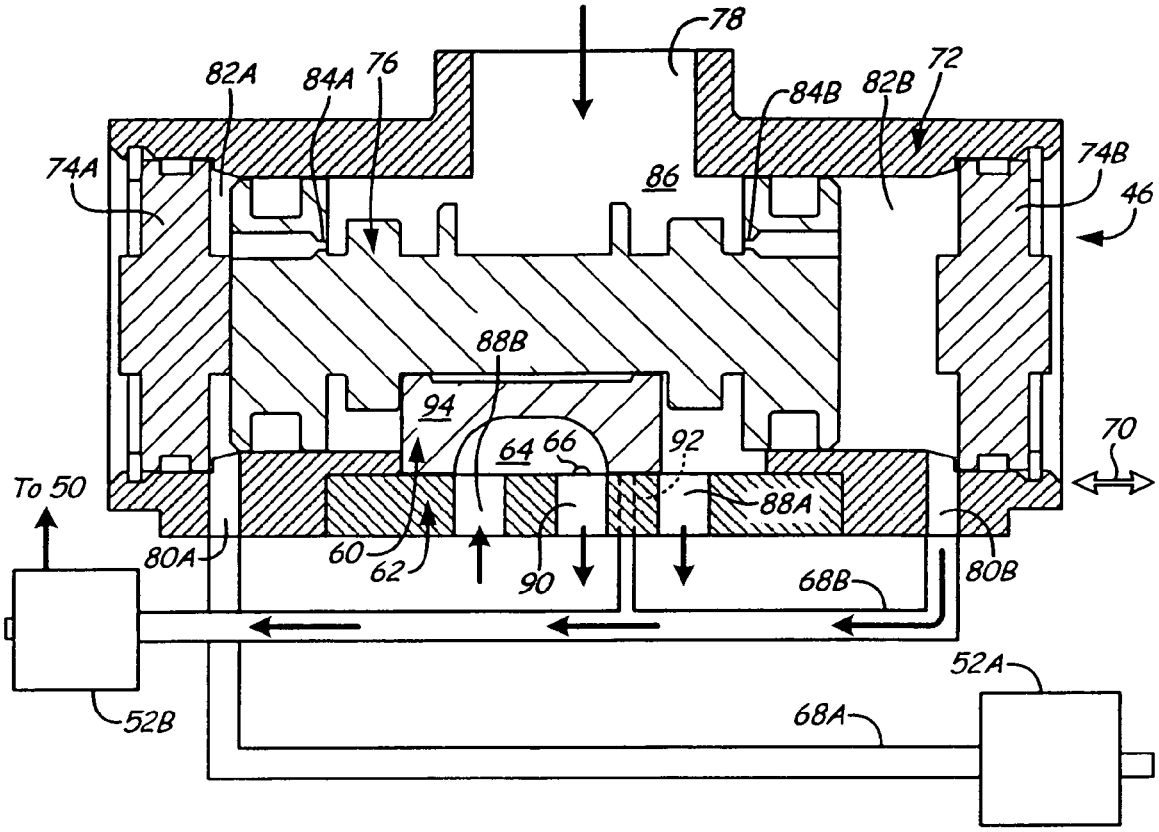
FIG. 3A is a front cross-section view of an air valve assembly having a cup in a leftmost position.

In FIG. 3A, a front cross-section view of air valve assembly 46 is shown including cup 60 in a leftmost position. Shown in FIG. 3A are air valve assembly 46, limit switches 52A-52B, cup 60, plate 62, gas cavity 64, pilot slot 66, pilot lines 68A-68B, first axis 70, valve body 72, end caps 74A-74B, air valve piston 76, valve inlet 78, pilot ports 80A-80B, valve chambers 82A-82B, bleed ports 84A-84B, inlet chamber 86, chamber ports 88A-88B, exhaust port 90, reset port 92, and cup body 94. It should be recognized that references to directions such as "left", "right", "top", and "bottom" are merely explanatory and are made with respect to the view of air valve assembly 46 shown in FIG. 3A.

Air valve assembly 46 includes a hollow valve body 72 that lies lengthwise parallel to first axis 70. Air valve assembly 46 has end caps 74A-74B at the ends of valve body 72, and pilot ports 80A-80B in valve body 72 near end caps 74A-74B, respectively. At the top of valve body 72 is valve inlet 78, and attached to the bottom of valve body 72 is plate 62. Slidably positioned in valve body 72 are cup 60 and air valve piston 76. Cup 60 is positioned between air valve piston 76 and plate 62, and cup 60 is captured by protrusions from air valve piston 76. Therefore, cup 60 and air valve piston 76 slide in the direction of axis 70 together. Furthermore, cup 60 slides adjacent to plate 62.

Cup 60 includes cup body 94 into which gas cavity 64 and pilot slot 66 extend. Plate 62 includes chamber ports 88A-88B which are fluidly connected to gas chambers 44A-44B (shown in FIG. 2), respectively, and exhaust port 90 which is fluidly connected to pneumatic outlet 50 (shown in FIG. 2). Plate also has reset port 92.

Valve inlet 78 is fluidly connected to inlet chamber 86 in air valve assembly 46. Thereby, inlet chamber 86 is fluidly connected to gas manifold 42 (shown in FIG. 2). Inlet chamber 86 is also fluidly connected to valve chambers 82A-82B, which are fluidly connected to pilot ports 80A-80B, respectively. Pilot ports 80A-80B are fluidly connected to pilot lines 68A-68B, respectively. Pilot lines 68A-68B are fluidly connected to limit switches 52A-52B, respectively. In addition, pilot line 68B is fluidly connected to reset port 92 in plate 62.

Cup 60 is moveable between a leftmost exhaust position (now shown in FIG. 3A), a centered position (later shown in FIG. 3B), and a rightmost exhaust position (not shown). When cup 60 is in the leftmost exhaust position, gas cavity 64 fluidly connects chamber port 88B with exhaust port 90. In addition, inlet chamber 86 is fluidly connected to chamber port 88A. This fluidly connects gas chamber 44B with pneumatic outlet 50 and gas chamber 44A with gas manifold 42 (all shown in FIG. 2).

During operation of motor 10 (shown in FIG. 2), with cup 60 in the leftmost position, pressurized gas flows through air valve assembly 46 from gas manifold 42 (shown in FIG. 2), into valve inlet 78, to inlet chamber 86, around air valve piston 76 (between air valve piston 76 and valve body 72), through chamber port 88A, and out to gas chamber 44A (shown in FIG. 2). In addition, gas flows from inlet chamber 86 to valve chamber 82A through bleed port 84A. Pressurized gas also flows through air valve assembly 46 from gas chamber 44B (shown in FIG. 2), into chamber port 88B, through gas cavity 64, into exhaust port 90, and out to pneumatic outlet 50 (shown in FIG. 2).

As stated previously, the flow of gas into gas chamber 44A and out of gas chamber 44B causes primary piston 48 to move toward fluid chamber 36A (all shown in FIG. 2). After a sufficient amount of movement, primary piston 48 will come in contact with and activate limit switch 52B. Limit switch 52B then sends a signal to air valve assembly 46 to move cup 60 to the rightmost position. In the illustrated embodiment, this signal is a pneumatic signal. More specifically, limit switch 52B is a normally closed pneumatic valve that opens when it is activated. When limit switch 52B opens, the pressurized gas in pilot line 68B, pilot port 80B, and valve chamber 82B is exhausted to pneumatic outlet 50 (shown in FIG. 2), which substantially drops the pressure inside valve chamber 82B (as denoted by the arrows). Because valve chamber 82A is pressurized due to gas having previously flowed in from valve inlet 78 through bleed port 84A, air valve piston 76 and cup 60 are forced to move rightward. Although pressurized gas does flow into valve chamber 82B through bleed port 84B, bleed port 84B is too restrictive to allow enough gas into valve chamber 82B to arrest the movement of air valve piston 76.

Once air valve piston 76 and cup 60 have moved to the rightmost position, pressurized gas flows through air valve assembly 46 from valve inlet 78 to chamber port 88B and valve chamber 82B. Pressurized gas also flows through air valve assembly 46 from chamber port 88A to exhaust port 90. This causes primary piston 48 (shown in FIG. 2) to move toward fluid chamber 36B (shown in FIG. 2). After a sufficient amount of movement, primary piston 48 will come in contact with and activate limit switch 52A. Limit switch 52A then sends a signal to air valve assembly 46 to move cup 60 to the leftmost position. In the illustrated embodiment, this signal is a pneumatic signal. More specifically, limit switch 52A is a normally closed pneumatic valve that opens when it is activated. When limit switch 52A opens, the pressurized gas in pilot line 68A, pilot port 80A, and valve chamber 82A is exhausted to pneumatic outlet 50 (shown in FIG. 2), which substantially dropping the pressure inside valve chamber 82A (not denoted by the arrows). Because valve chamber 82B is pressurized due to gas having previously flowed in from valve inlet 78 through bleed port 84B, air valve piston 76 and cup 60 are forced to move leftward. Although pressurized gas does flow into valve chamber 82A through bleed port 84A, bleed port 84A is too restrictive to allow enough gas into valve chamber 82A to arrest the movement of air valve piston 76. Once air valve piston 76 and cup 60 have moved to the leftmost position, the above cycle will occur again.

The components and configuration of air valve assembly 46 as shown in FIG. 3A allow for air valve assembly 46 to control the flow of pressurized gas within motor 10 (shown in FIG. 1). More specifically, air valve assembly 46 can automatically switch the flow of gas to cause primary piston 48 (shown in FIG. 2) to reciprocate. This control continues indefinitely as long as there is sufficiently pressurized gas supplied to pneumatic inlet 24 (shown in FIG. 1), unless pneumatic outlet 50 (shown in FIG. 2) is substantially clogged or the movement of primary piston 48 (shown in FIG. 2), air valve piston 46, or cup 60 is substantially impeded.

Figure 3B:
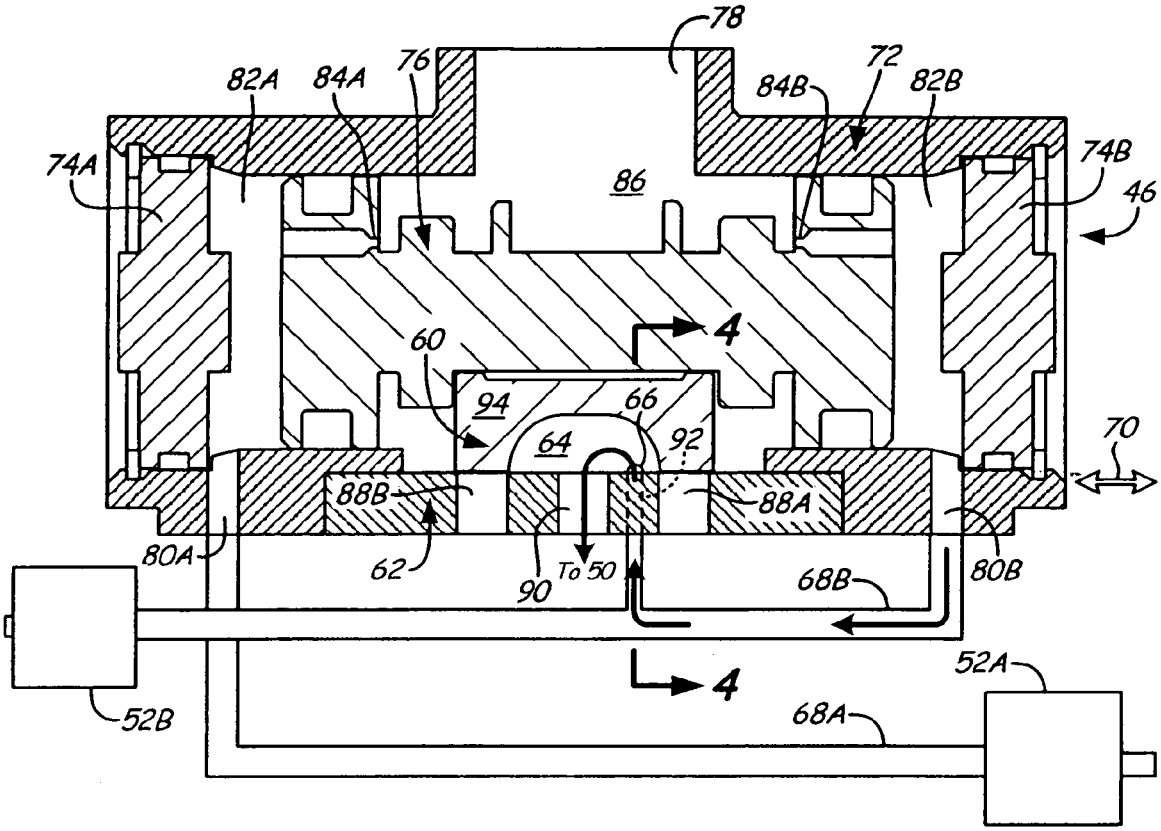
FIG. 3B is a front cross-section view of an air valve assembly having a cup in a centered position.

In FIG. 3B, a front cross-section view of air valve assembly 46 having cup 60 in a centered position is shown. Shown in FIG. 3B are air valve assembly 46, limit switches 52A-52B, cup 60, plate 62, gas cavity 64, pilot slot 66, pilot lines 68A-68B, first axis 70, valve body 72, end caps 74A-74B, air valve piston 76, valve inlet 78, pilot ports 80A-80B, valve chambers 82A-82B, bleed ports 84A-84B, inlet chamber 86, chamber ports 88A-88B, exhaust port 90, reset port 92, and cup body 94. It should be recognized that references to directions such as "left", "right", "top", and "bottom" are merely explanatory and are made with respect to the view of air valve assembly 46 shown in FIG. 3B.

Depicted in FIG. 3B is a situation wherein air valve piston 76 and cup 60 are stopped in the center position. The distance between chamber ports 88A-88B in plate 62 is wider than gas cavity 64 of cup 60. In addition, each chamber port 88A-88B is covered by cup body 94. Therefore, pressurized gas cannot flow from inlet chamber 86 to any of chamber ports 88A-88B. Thereby, primary piston 46 (shown in FIG. 2) will not activate any of limit switches 52A-52B. In the typical prior art motor, the air valve assembly would be stalled if the air valve piston and cup stopped in the center position. This is because there is no component in the system to send a signal to the air valve assembly to move the air valve piston or the cup. In such a situation, an operator would have to jar the air valve assembly in hopes that the air valve piston and cup would move to one side or the other. If that did not work, the operator would then have to disassemble the motor and move the air valve piston and cup manually.

However, according to the present invention, cup 60 has pilot slot 66 and plate 62 has reset port 92. In the illustrated embodiment, pilot slot 66 extends rearward (into the page) from gas cavity 64. Reset port 92 is located between chamber port 88A and exhaust port 90, such that pilot slot 66 fluidly connects with reset port 92 when cup 60 is in the centered position.

When air valve piston 76 and cup 60 are in the center position, cup 60 sends a signal to air valve assembly 46 to move air valve piston 76 and cup 60 to the rightmost position. In the illustrated embodiment, this signal is a pneumatic signal. More specifically, cup 60 fluidly connects valve chamber 82B with exhaust port 90. This connection exhausts the pressurized gas in pilot line 68B, pilot port 80B, and valve chamber 82B through reset port 92, pilot slot 66, gas cavity 64, and exhaust port 90 (as denoted by arrows) and out to pneumatic outlet 50 (shown in FIG. 2). Thereby, the pressure inside valve chamber 82B is substantially dropped. Because valve chamber 82A is pressurized due to gas having previously flowed in from valve inlet 78 through bleed port 84A, air valve piston 76 and cup 60 are forced to move rightward. Once air valve piston 76 and cup 60 have moved to the rightmost position, normal operation of air valve assembly 46 is possible.

In the illustrated embodiment, the signal sent by cup 60 to air valve assembly 46 will exclusively be a signal to send air valve piston 76 and cup 60 to the rightmost position. This is because reset port 92 is fluidly connected to pilot line 68B.

The components and configuration of air valve assembly 46 as shown in FIG. 3B allow for air valve assembly 46 to reset itself if it ever stops with air valve piston 76 and cup 60 in the centered position. This resetting occurs automatically and without operator intervention.

Depicted in FIG. 3B is one embodiment of the present invention, to which there are alternative embodiments. For example, cup 60 can send a signal to air valve assembly 46 to move air valve piston 76 and cup 60 to the leftmost position. In such an embodiment, reset port 92 is connected to pilot line 68A and not to pilot line 68B. For another example, the present invention can be used in an air valve wherein the stall position is not in the traditional center position. In such an embodiment, reset port 92 is located to be fluidly connected with pilot slot 66 when air valve piston 76 and cup 60 are in this non-traditional stall position.

Figure 4:
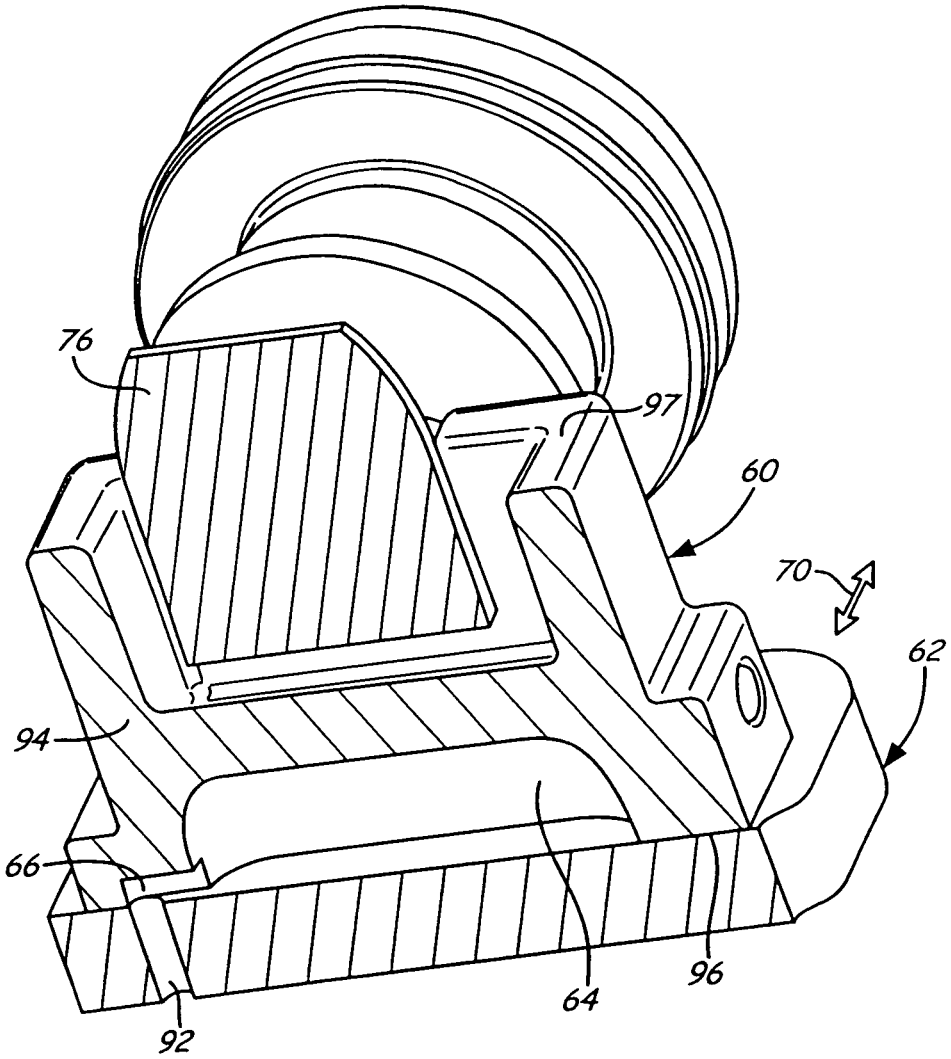
FIG. 4 is a side perspective cross-section view of the cup, an air valve piston, and a plate along line 4-4 in FIG. 3B.

In FIG. 4, a side perspective cross-section view of cup 60, air valve piston 76, and plate 62 along line 4-4 in FIG. 3B is shown. Shown in FIG. 4 are cup 60, plate 62, gas cavity 64, pilot slot 66A, first axis 70, air valve piston 76, reset port 92, cup body 94, sliding face 96, and cup protrusion 97.

As stated previously, cup 60 slides adjacent to plate 62 along first axis 70 because cup protrusion 97 is captured by air valve piston 76. More specifically, cup 60 has sliding face 96 as one of the sides of cup body 94, and sliding face 96 contacts plate 62. Sliding face 96 is substantially planar and creates a sufficient seal against plate 62 to ensure the selected gas flow paths are connected. For example, when air valve piston 76 and cup 60 are in the center position (as shown in FIG. 4), reset port 92 is fluidly connected to pilot slot 66.

Due to the substantially smaller sizes of reset port 92 and pilot slot 66, as compared to the sizes of gas cavity 64 and chamber ports 88A-88B (shown in FIGS. 3A-3B), gas flow therethrough is restricted. Thereby, the signal sent to air valve assembly 46 (shown in FIGS. 3A-3B) is substantially smaller in magnitude than the signals sent to air valve assembly 46 by limit switches 52A-52B (shown in FIGS. 3A-3B). Preferably, the signal sent by cup 60 is less than or equal to approximately one half as strong as the signals sent by limit switches 52A-52B.

In the illustrated embodiment, cup 60 allows for pressurized gas to travel from reset port 92 to exhaust port 90 (shown in FIGS. 3A-3B) for a brief period of time as air valve piston 76 and cup 60 reciprocate between the rightmost and the leftmost positions during normal operation. This pneumatic signal is too weak to arrest the movement of air valve piston 76 and cup 60. Thereby, there is no interruption of the normal operation of air valve assembly 46 (shown in FIGS. 3A-3B) by cup 60.

The configurations of cup 60 and plate 62 as shown in FIG. 4 allow for air valve assembly 46 (shown in FIGS. 3A-3B) to be reset if air valve piston 76 and cup 60 are stopped in the center position. In addition, due to the reduced magnitude, the signal sent by cup 60 as air valve piston 76 and cup 60 move along axis 70 does not interfere with the normal operation of air valve assembly 46.

Figure 5:
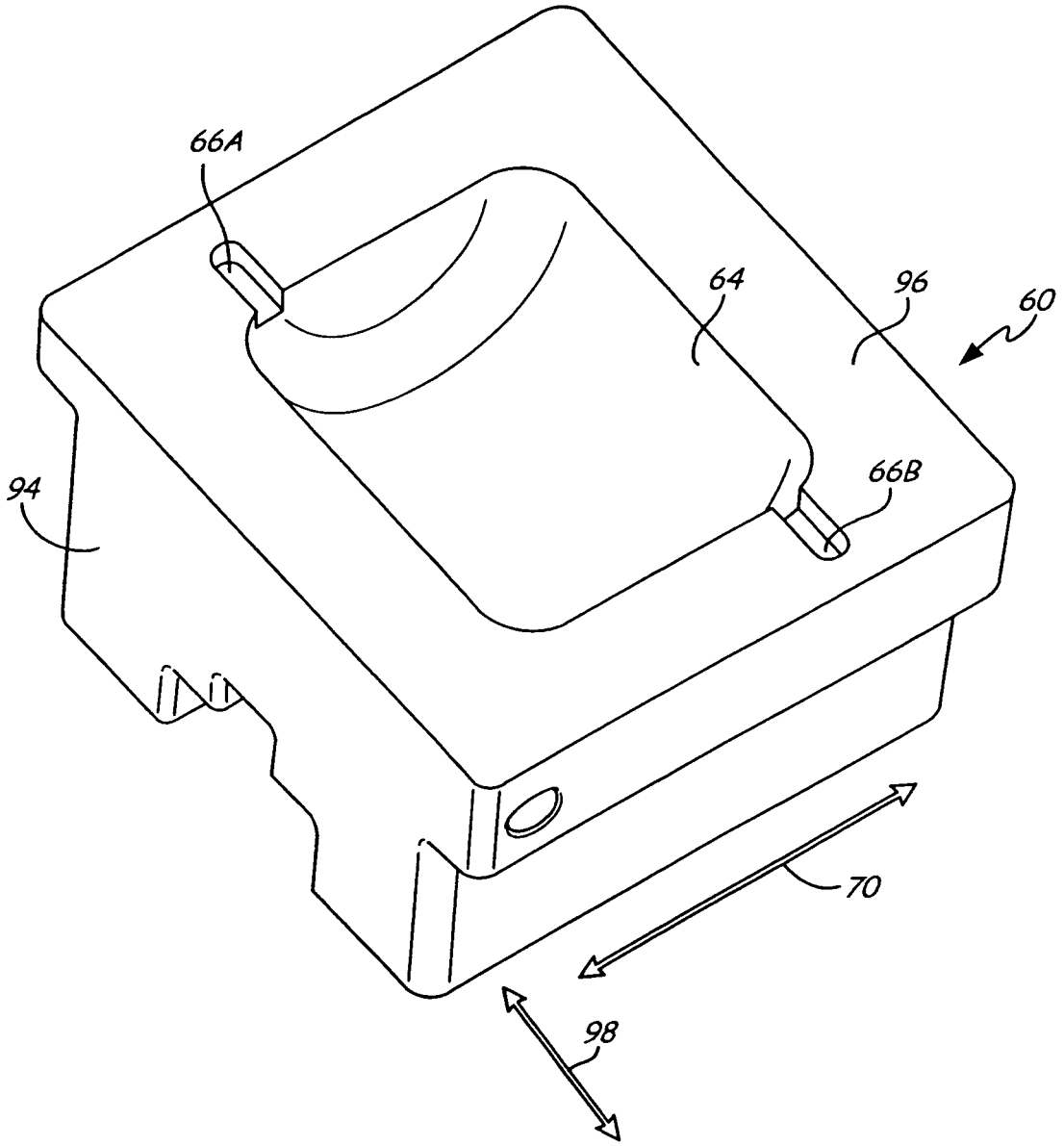
FIG. 5 is a bottom perspective view of the cup showing a gas cavity, pilot slots, and a sliding face.

In FIG. 5, a bottom perspective view of cup 60 is shown having gas cavity 64, pilot slots 66A-66B, and sliding face 96. Shown in FIG. 4 are cup 60, gas cavity 64, pilot slots 66A-66B, first axis 70, cup body 94, sliding face 96, and second axis 98.

Cup 60 has a rectilinear cup body 94 with sliding face 96 as one side. Gas cavity 64 has a concave shape that extends into cup body 94 through sliding face 96 and terminates in cup body 94. Pilot slots 66A-66B extend from gas cavity 64 and into cup body 94 through sliding face 96 and terminate in cup body 94. Pilot slots 66A-66B extend from gas cavity 64 substantially along second axis 98. Second axis 98 is substantially perpendicular to first axis 70. In the illustrated embodiment, pilot slot 66A extends from gas cavity 64 on the opposite side from pilot slot 66B. Because there is one reset port 92 (shown in FIG. 4), only one pilot slot 66 is functional. During assembly of air valve assembly 46 (shown in FIGS. 3A-3B), cup 60 can be installed with two orientations that result in substantially the same configuration of air valve assembly 46. The only difference being which pilot slot 66 can fluidly connect with reset port 92. When combined with other assembly-restricting features of cup 60, cup 60 will always be oriented properly for gas cavity 64 to be fluidly connectable with reset port 92.

Depicted in FIG. 5 is one embodiment of the present invention, to which there are alternative embodiments. For example, there can be one pilot slot 66. In such an embodiment, cup 60 can have additional assembly-restricting features to ensure proper assembly of cup 60 in air valve assembly 46, such that pilot slot 66 will be able to fluidly connect with reset port 92.

It should be recognized that the present invention provides numerous benefits and advantages. In general, motor 10 can start and restart itself if it is stopped. More specifically, for example, if motor 10 is iced up, it will restart after the ice melts. Similarly, if motor 10 stops due to insufficient gas pressure, it will restart after sufficient pressure is provided. Furthermore, if muffler 12 and/or pneumatic outlet 50 is clogged, motor 10 will resume operation as soon as the clog is removed.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cup for an air valve assembly in a positive displacement pneumatic motor, the cup comprising:
- a rectilinear cup body having a substantially planar sliding face as one side of the cup body;
- a gas cavity that extends into the cup body through the sliding face and terminates within the cup body;
- a first pilot slot that extends from the gas cavity and into the cup body through the sliding face, the first pilot slot terminating within the cup body;
- a second pilot slot that extends from the gas cavity and into the cup body through the sliding face; and
- a protrusion from the cup body that is captured by an air valve piston, wherein the cup moves with the air valve piston.

2. The cup of claim 1, and further comprising:
- a first axis along which the cup moves; and
- a second axis that is orthogonal to the first axis;
- wherein the first pilot slot extends substantially parallel to the second axis.

3. An air valve assembly comprising:
- a plate having a first chamber port, a second chamber port, an exhaust port, and a reset port;
- an air valve body;
- an air valve piston slidably positioned inside the air valve body; and
- a cup being moveable between a first exhaust position, a stall position, and a second exhaust position, the cup comprising:
  - a cup body having a sliding face as one side of the cup body, the sliding face being adjacent to the plate;
  - a gas cavity that extends into the cup body through the sliding face, the gas cavity being fluidly connected to the exhaust port;
  - a first pilot slot that extends from the gas cavity and into the cup body through the sliding face, wherein the first pilot slot is fluidly connected to the reset port when the cup is in the stall position;
  - a second pilot slot that extends from the gas cavity and into the cup body through the sliding face; and
  - a protrusion from the cup body that is captured by the air valve piston, wherein the cup moves with the air valve piston.

4. The air valve assembly of claim 3, and further comprising:
- a valve chamber between the air valve body and an end of the air valve piston, wherein the valve chamber is fluidly connected to the exhaust port through the reset port and the first pilot slot when the cup is in the stall position.

5. The air valve assembly of claim 3, wherein a distance between the first chamber port and the second chamber port is less than a width of the gas cavity.

6. The air valve assembly of claim 3, wherein the sliding face covers both the first and second chamber ports when the cup is in the stall position.

7. The air valve assembly of claim 3, wherein the cup further comprises:

a first axis along which the cup moves; and a second axis that is orthogonal to the first axis;

wherein the first pilot slot extends substantially parallel to the second axis.

8. A positive displacement pneumatic motor comprising:

a motor body;

a pneumatic inlet attached to the motor body for receiving compressed gas for the motor;

a primary piston positioned in the motor body, the primary piston being movable due to force from the compressed air;

an air valve assembly including a cup that is slidable between a first position, a stall position, and a second position, wherein the position of the cup controls the flow of compressed air in the motor, the air valve assembly comprising:

a plate having a first chamber port, a second chamber port, an exhaust port, and a reset port;

wherein the cup comprises:

a cup body having a sliding face as one side of the cup body, the sliding face being adjacent to the plate;

a gas cavity that extends into the cup body through the sliding face, the gas cavity being fluidly connected to the exhaust port; and a first pilot slot that extends from the gas cavity and into the cup body through the sliding face, wherein the first pilot slot is fluidly connected to the reset port when the cup is in the stall position which sends the second signal by providing a fluidly connected pathway for exhausting gas in the air valve assembly; and a second pilot slot that extends from the gas cavity and into the cup body through the sliding face;

a limit switch that is activated when the primary piston moves a sufficient distance, the limit switch sending a first pneumatic signal when it is activated to the air valve assembly, wherein the air valve assembly moves the cup between the first and second positions due to the first pneumatic signal; and wherein the cup sends a second signal to the air valve assembly when the air valve assembly is in the stall position to move the cup to the first-position.

9. The motor of claim 8, wherein the signal that the cup generates causes the air valve assembly to move the cup exclusively to the first position.

10. The motor of claim 8, and further comprising:

a pneumatic pilot line connected to the limit switch and the air valve assembly, wherein the reset port is fluidly connected to the pilot line.

11. The motor of claim 8, wherein the air valve assembly further comprises:

an air valve body;

an air valve piston slidably positioned inside the air valve body, wherein the air valve piston controls the movement of the cup.

12. The motor of claim 11, and further comprising:

a valve chamber between the air valve body and an end of the air valve piston, wherein the valve chamber is fluidly connected to the exhaust port when the cup is in the stall position.

13. The motor of claim 8, wherein the sliding face covers both the first and second chamber ports when the cup is in the stall position.

* * * * *